US008695961B2

(12) United States Patent
Uchida

(10) Patent No.: US 8,695,961 B2
(45) Date of Patent: Apr. 15, 2014

(54) SHEET FEEDER, PROCESSING DEVICE, AND RECORDING APPARATUS WITH FIRST AND SECOND ROLLERS AND STACKING PARTS

(75) Inventor: Haruo Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/523,046

(22) Filed: Jun. 14, 2012

(65) Prior Publication Data

US 2013/0001856 A1 Jan. 3, 2013

(30) Foreign Application Priority Data

Jun. 30, 2011 (JP) ..... 2011-145771

(51) Int. Cl.
*B65H 3/44* (2006.01)

(52) U.S. Cl.
CPC ..... *B65H 3/44* (2013.01)
USPC ..... 271/9.11; 271/117; 271/164; 271/171

(58) Field of Classification Search
USPC ..... 271/9.11, 164, 117, 171
See application file for complete search history.

(56) References Cited

U.S. PATENT DOCUMENTS 5,177,547 A 1/1993 Kanemitsu et al.
5,673,074 A 9/1997 Miyauchi et al.
5,738,452 A 4/1998 Uchida
5,742,318 A 4/1998 Miyauchi et al.
7,628,392 B2 * 12/2009 Shiohara et al. ..... 271/9.11
7,722,030 B2 * 5/2010 Sugiyama et al. ..... 271/117
7,980,547 B2 * 7/2011 Ito et al. ..... 271/9.11
2010/0245515 A1 9/2010 Uchida et al.

FOREIGN PATENT DOCUMENTS

JP 61-277525 A 12/1986
JP 2002-338070 A 11/2002

* cited by examiner

*Primary Examiner* — Gerald McClain

(74) *Attorney, Agent, or Firm* — Fitzpatrick, Cella, Harper & Scinto

(57) ABSTRACT

A sheet printer includes sheet stacking and supplying parts that overlap each other at upper and lower stages, and the first sheet stacking and supplying part includes a first feeding roller that separates, supplies and conveys a sheet, and a first feeding roller arm that holds the first feeding roller so as to be capable of abutting on the sheet, and rotates about an axis. The second sheet stacking and supplying part includes a second feeding roller that separates, supplies and conveys a sheet, and a second feeding roller arm that holds the second feeding roller so as to be capable of abutting on the sheet, and rotates about an axis. The second feeding roller arm is disposed outside the first sheet stacking and supplying part in a direction that intersects a supplying and conveying direction of the sheet.

20 Claims, 5 Drawing Sheets

SHEET FEEDER, PROCESSING DEVICE, AND RECORDING APPARATUS WITH FIRST AND SECOND ROLLERS AND STACKING PARTS

BACKGROUND OF THE INVENTION

1. Field of the Invention

The present invention relates to a sheet feeder provided in recording apparatuses, such as printers.

2. Description of the Related Art

In recent years, in recording apparatuses, such as personal color printers, a recording apparatus in which a feeding unit, which supplies paper to a sheet recording region of the recording apparatus, is arranged on the front side of the apparatus is increasing with a view to improving operability for the user. Moreover, a recording apparatus is increasing in which the user operability of a sheet is improved by providing a feeding unit with two sheet stacking parts capable of sorting and setting regular paper and gloss paper for photo printing independently.

Sheet feeding and conveying mechanisms in related-art printers will now be described.

For example, a related-art printer shown in Japanese Patent Application Laid-Open No. 2002-338070 is arranged so that portions of a plurality of feeding trays overlap each other vertically. The size of sheets in a stacking direction is able be made small by arranging a feeding roller of a lower-stage feeding tray at a position where the feeding roller does not overlap an upper-stage feeding tray.

In a paper cassette described in Japanese Patent Application Laid-Open No. S61-277525, a secondary paper accommodating portion is arranged above a cassette body. A smaller size of paper than the cassette body is accommodated in the secondary paper accommodating portion. The secondary paper accommodating portion is retracted in a direction opposite to a feeding direction when the paper in the cassette body is fed, and a feeding roller feeds the paper stacked in the cassette body. When the paper stacked in the secondary paper accommodating portion is fed, the secondary paper accommodating portion is advanced in the feeding direction, and the paper in the secondary paper accommodating portion is fed by the feeding roller.

However, the technique disclosed in Japanese Patent Application Laid-Open No. 2002-338070 is able to realize miniaturization in the sheet stacking direction (height direction), by limiting the paper width size of the upper-stage feeding cassette 103 to a small size. Therefore, the upper-stage feeding cassette 103 cannot be adapted so as to cope with even sheets of the same maximum size as the lower-stage feeding cassette 104. That is, sheets, such as regular paper, and gloss paper for photo printing of maximum size, cannot be simultaneously set through the configuration having the two sheet stacking and supplying parts.

Therefore, in a case where the gloss paper for photo printing of maximum size or the like is set, there is a problem in that inconvenience occurs such that sheets should be replaced and set with respect to a feeding cassette (lower-stage feeding cassette 103) capable of setting sheets of maximum size.

On the other hand, the same size of paper is able to be accommodated in the sheet width direction in the paper cassette of Japanese Patent Application Laid-Open No. S61-277525.

However, since paper to be fed is selected by advancing or retracting the secondary paper accommodating portion in the feeding direction with respect to the cassette body, there is a problem in that the size in the feeding direction has to be limited to a small size.

SUMMARY OF THE INVENTION

Thus, in view of the above-described problems, an object of the invention is to be able to cope with sheets of maximum size even in both upper and lower stages in a configuration in which a plurality of sheet stacking and supplying parts is overlapped with each other in multiple stages, and to keep the configuration compact.

The invention provides a sheet feeder including: a plurality of sheet stacking parts that overlap each other at least at upper and lower stages, an upper-stage roller that feeds sheets stacked on the upper-stage sheet stacking part; an upper-stage arm that holds the upper-stage roller and is supported rotatably; a lower-stage roller that feeds sheets stacked on the lower-stage sheet stacking part; and a lower-stage arm that holds the lower-stage roller and is supported rotatably. At least a portion of the upper-stage sheet stacking part and at least a portion of the lower-stage arm are arranged so as to be lined up in the width direction of the sheets stacked on the upper-stage sheet stacking part.

According to the invention, it is possible to cope with sheets of maximum size in both upper and lower stages in a configuration in which a plurality of sheet stacking and supplying parts is overlapped with each other in multiple stages, and to keep configuration compact.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1A:
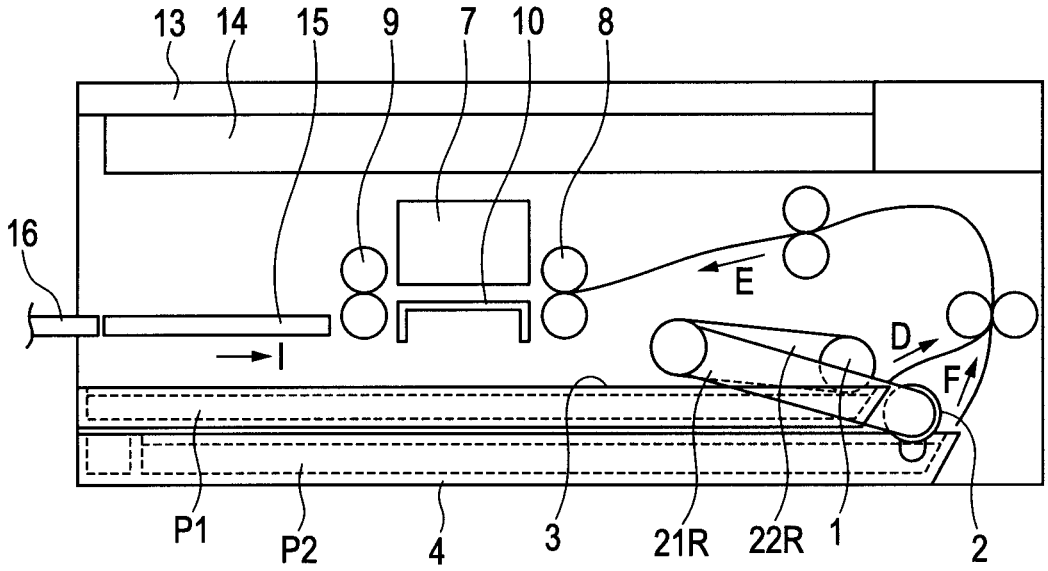
FIGS. 1A and 1B are cross-sectional views of a printer of a first embodiment.
Figure 1B:
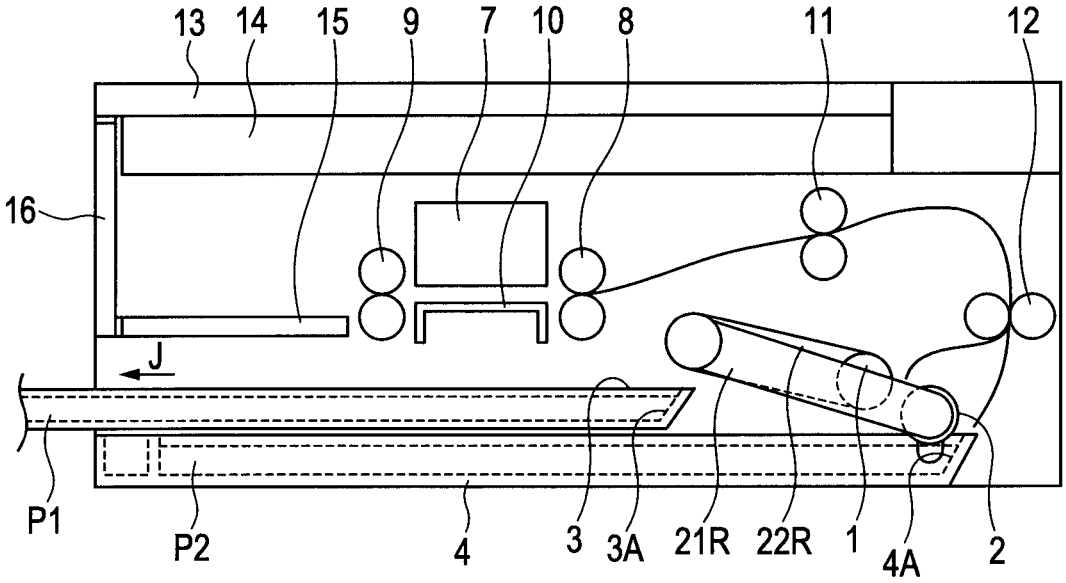
Figure 2:
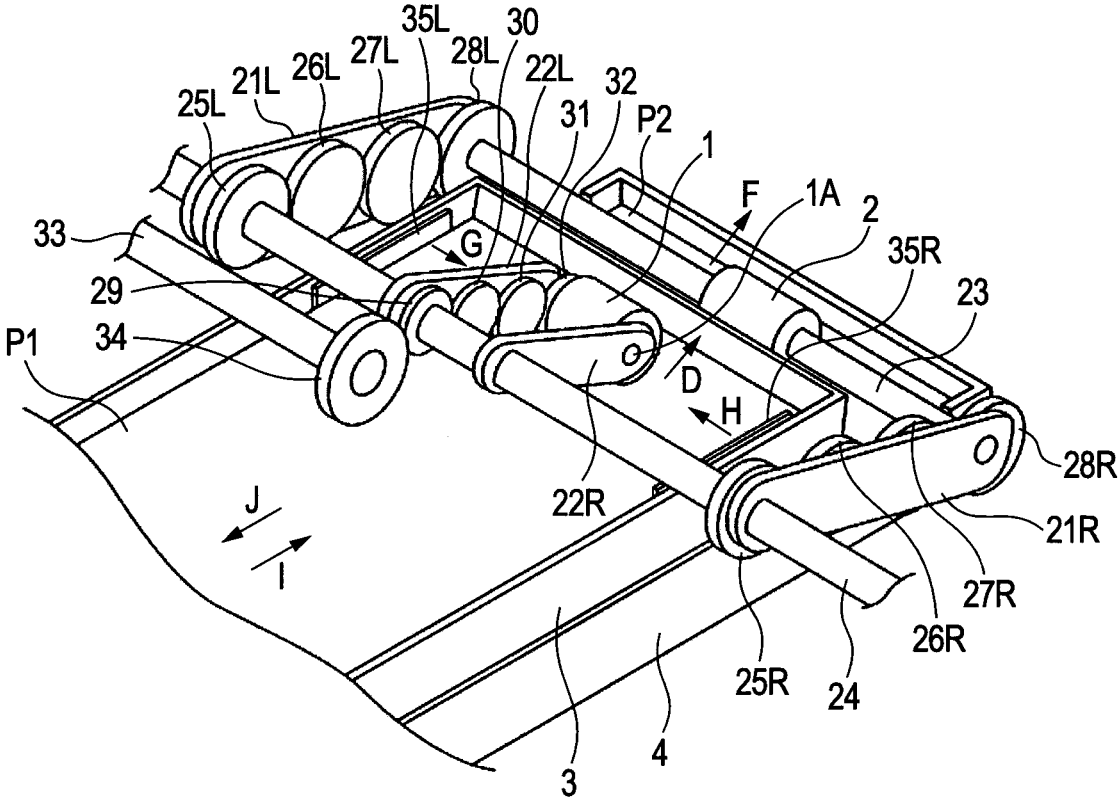
FIG. 2 is a perspective view illustrating a configuration of a feeding unit portion of the first embodiment.

A first embodiment of the invention will be described with reference to FIGS. 1A to 4. FIGS. 1A and 1B are cross-sectional views of a printer body, FIG. 2 is a perspective view illustrating the configuration of a feeding unit in the first embodiment, FIG. 3 is a block diagram illustrating the circuit of the printer, and FIG. 4 is a partial perspective view of the printer as seen from the front side of the printer body.

In FIGS. 1A to 3, the printer of the present embodiment includes a recording head 7 that ejects ink selectively from a plurality of discharge ports to perform recording. The recording head 7 is positioned and held by a carriage (not illustrated), and reciprocates in a direction (perpendicular to the paper planes of FIGS. 1A and 1B) substantially parallel to a sheet and perpendicular to a conveying direction of the sheet to perform printing on the sheet. A region that faces the ink discharge surface of the recording head 7 when the carriage reciprocates becomes a printing unit, and this printing unit is provided with a platen 10 that holds a sheet.

A conveying roller pair 8 is arranged on the upstream side in a sheet conveying direction of the recording head 7 to convey a sheet to the printing unit. A sheet discharge roller pair 9 is arranged on the downstream side in the sheet conveying direction of the recording head 7, and a printed sheet is discharged and conveyed to a sheet discharge unit formed by a discharged sheet stacking part 15 and a sheet discharge tray 16. The sheet discharge tray 16 functions also as a lid that opens and closes a sheet discharge port on the front of a printer body. A scanner 14 is arranged at an upper part of the printer body, and a document pressure plate part 13 that comes into pressure contact with a document is arranged at an upper part of the scanner 14.

Figure 3:
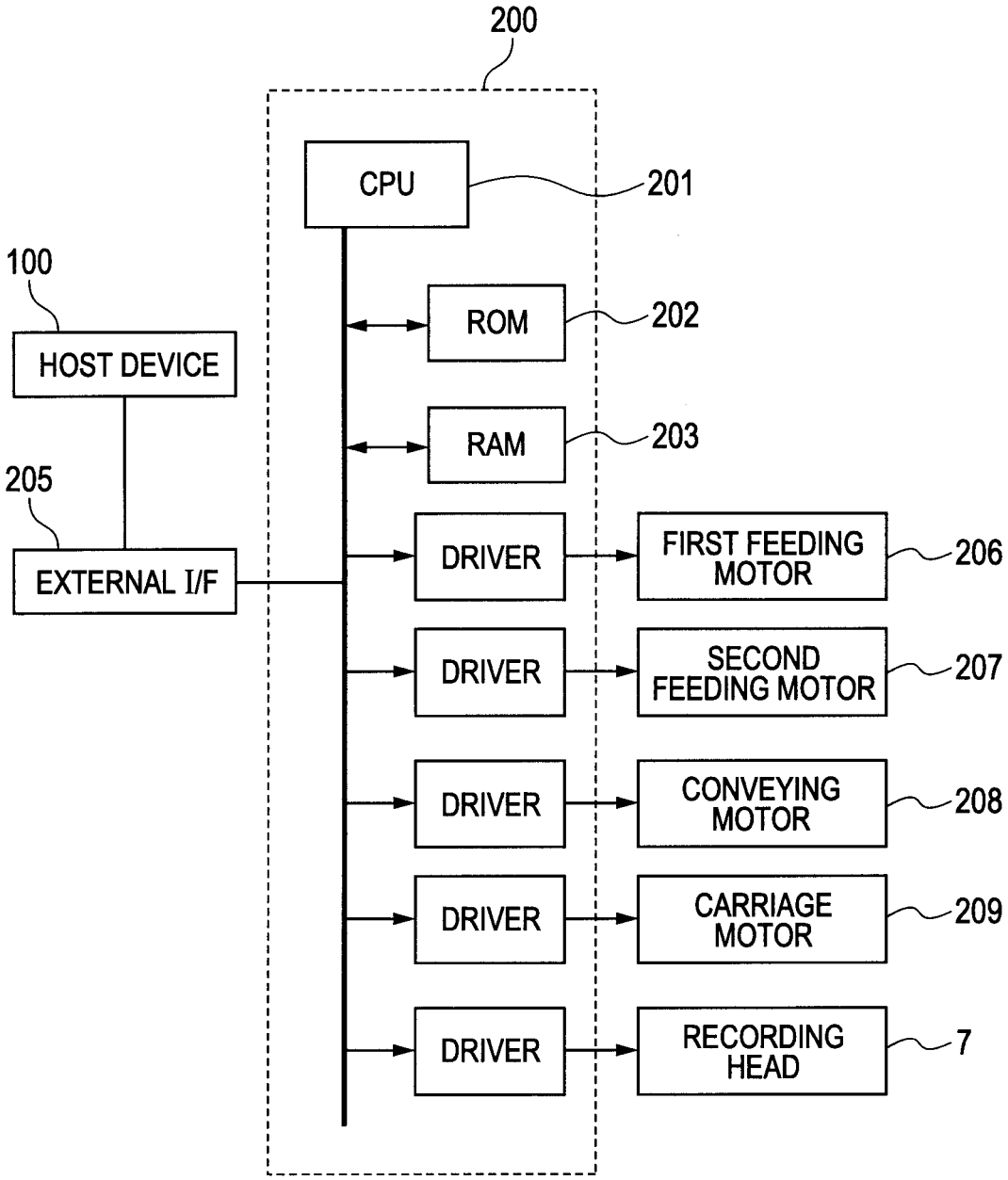
FIG. 3 is a block diagram illustrating the circuit of the printer.
Figure 4:
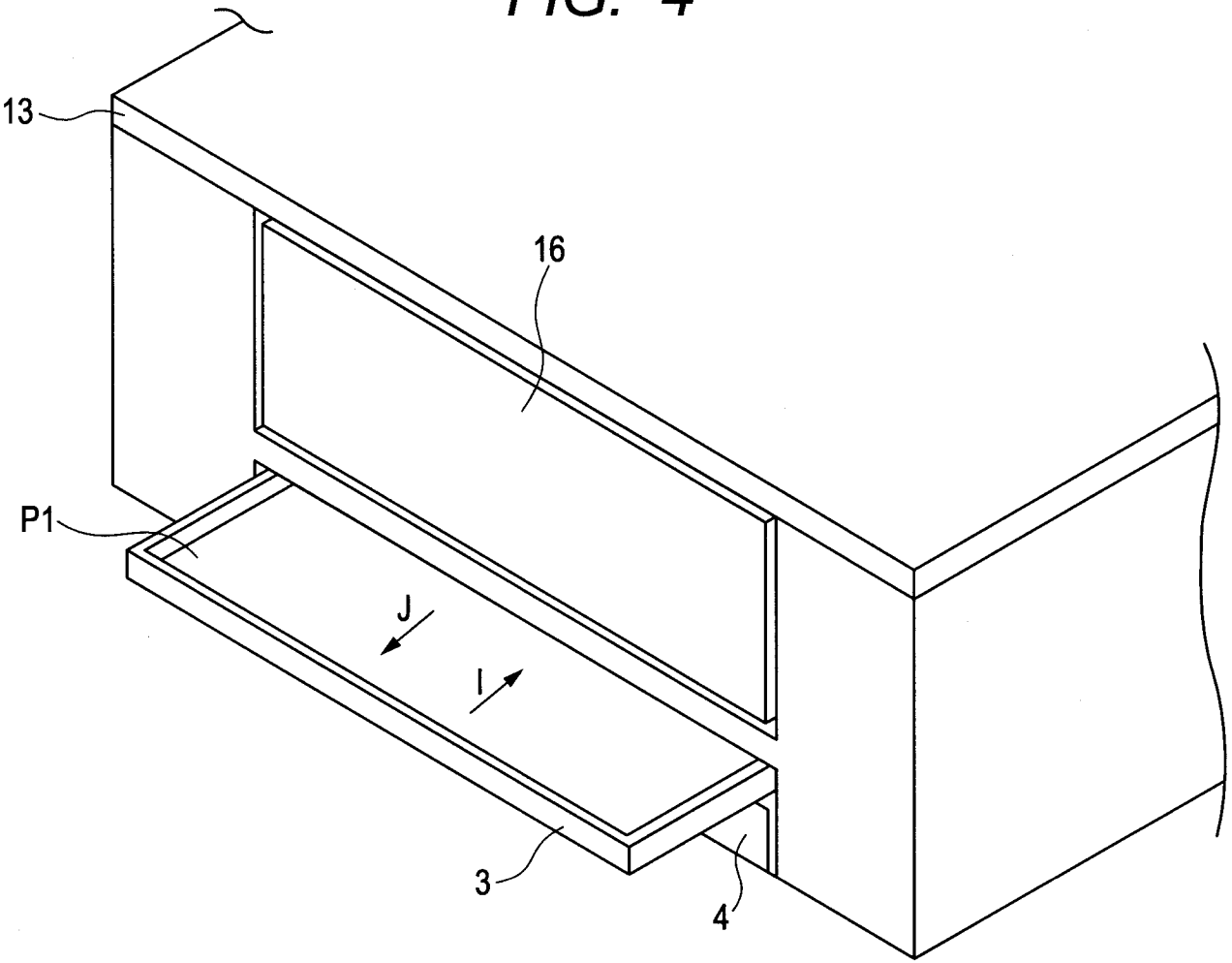
FIG. 4 is a partial perspective view of the printer of the first embodiment.

FIG. 3 illustrates a control unit 200 of a printer. The control unit 200 includes a CPU 201 that executes control, a ROM 202 in which programs or various kinds of fixed data are stored, and a ROM that is used as a work area and is used as a temporary storage region for various data. Additionally, the control unit 200 includes drivers that drive various kinds of motors and the recording head 7. The control unit 200 is connected to a host device 100, such as a computer, via an interface 205. A first feeding motor 206 performs feeding of a sheet from an upper-stage cassette, and a second feeding motor 207 performs feeding of a sheet from a lower-stage cassette. A carriage motor 209 moves the recording head 7.

Next, the configuration of a supply unit of a sheet will be described with reference to FIG. 1A. In the printer of the present embodiment, two sheet stacking and supplying parts corresponding to two types of sheets are disposed at upper and lower stages inside the printer body.

First, separating, feeding, and conveying operations from an upper-stage cassette 3 that is an upper sheet stacking and supplying part (first sheet stacking part) will be described. A plurality of sheets P1 are stacked and accommodated in the upper-stage cassette 3. The sheets P1 are, for example, gloss paper for photograph printing, or the like. The top sheet of the sheets P1 is fed by rotating an upper-stage feeding roller 1 (upper-stage roller) held between a pair of feeding arms (upper-stage arms) 22R and 22L (refer to FIG. 2 regarding reference numeral 22L) counterclockwise. An internal surface 3A of the wall on the side where the sheets of the upper-stage cassette 3 are fed includes a resistance member that gives feeding resistance to the tip of a sheet to be fed. This resistance member is one of a friction member and a knurled member. Only a top sheet that directly receives a feeding force from the feeding roller advances against the feeding resistance by this resistance member, and the sheets after the second sheet do not advance due to the feeding resistance. In this way, the top sheet is separated, advanced in the direction of arrow D, fed to the outside of the upper-stage cassette 3, and conveyed to the intermediate roller pair 12 and 11.

Moreover, the sheet P1 is conveyed in the direction of arrow E, conveyed to a conveying roller pair 8, conveyed to the printing unit by the conveying roller 8, and printed by the recording head 7. Moreover, the sheet P1 is conveyed to the sheet discharge roller pair 9, discharged and conveyed to the sheet discharge unit including the discharged sheet stacking part 15 and the sheet discharge tray 16 by the sheet discharge roller pair 9, and the printing operation is completed.

Next, separating, feeding, and conveying operations from the lower-stage cassette (second sheet stacking part) arranged under the upper-stage cassette 3 will be described. A plurality of sheets P2 are stacked and accommodated in the lower-stage cassette 4. The sheets P2 are regular paper or the like. A sheet P2 is fed and conveyed to the outside of the cassette while being separated in the direction of arrow F by a lower-stage feeding roller 2 (lower-stage roller) held between a pair of feeding arms 21R and 21L (refer to FIG. 2 regarding reference numeral 21L), and is conveyed to the intermediate roller pair 12 and 11. An internal surface 4A of the wall on the side where the sheets of the lower-stage cassette 3 are fed also includes a resistance member that gives feeding resistance to the tip of a sheet to be fed. Thereafter, the conveying operation of the sheet P2 is the same as the operation in the upper-stage cassette 3. Since the upper-stage cassette 3 and the lower-stage cassette 4 are fixed in a state where the upper-stage and lower-stage cassettes are mounted on the printer body and has the independent upper-stage feeding roller 1 and the independent lower-stage feeding roller 2, respectively, separation, feed, and convey from the upper-stage and lower-stage cassettes 3 and 4 are selectively possible.

Moreover, the configuration of the feeding unit will be described in detail with reference to FIG. 2.

First, the configuration of the feeding unit of the upper-stage cassette 3 and the upper-stage feeding roller 1 will be described.

The sheets P1 are stacked in the upper-stage cassette 3, and the upper-stage feeding roller 1 held by the two feeding arms 22R and 22L abuts on a sheet P1. One end of each of the feeding arms 22R and 22L is rotatably supported by a feeding roller driving shaft 24. The other ends of the feeding arms 22R and 22L rotatably journal both ends of a rotating shaft 1A that supports the upper-stage feeding roller 1, respectively. In addition, the feeding roller driving shaft 24 extends in a direction that intersects the supplying and conveying direction of the sheets P1 and P2, and the rotating shaft 1A of the upper-stage feeding roller 1 is disposed substantially parallel to the feeding roller driving shaft 24.

The first feeding motor 206 that is a first driving source applies a driving force to an input gear 34 for driving the upper-stage cassette via a driving shaft 33. The input gear 34 meshes with a driving idler gear 29 rotatably journalled on the feeding roller driving shaft 24, the above driving force is transmitted in order of the driving idler gears 30, 31, and 32, and the upper-stage feeding roller 1 is driven rotationally.

Side regulating plates 35R and 35L for making the size of a sheet in the width direction variable are provided on the right and left in the sheet width direction at the upper-stage cassette 3. FIG. 2 shows a set state of the sheets P1 with the width of maximum size. In a case where the sheets P1 with a small size in the width direction is set, the set position of the sheets with a small size is regulated by moving the right side regulating plate 35R in the direction of arrow H and moving the left side regulating plate 35L in the direction of arrow G, to set the spacing between the side regulating plates narrow. The side regulating plates 35R and 35L move in the width direction interlocking with each other by a rack & pinion (not illustrated). Additionally, the positioning reference of the sheets P1 in the width direction is a center reference, and the side regulating plates 35R and 35L are positioned at symmetrical positions about the center. With respect to the positioning of the center reference using the above side regulating plates, the lower-stage cassette 4 has also the same configuration (right and left side regulating plates (not illustrated)).

Next, the configuration of the feeding unit of the lower-stage cassette 4 and the lower-stage feeding roller 2 will be described. The sheets P2 are stacked in the lower-stage cassette 4, and the lower-stage feeding roller 2 held by the two feeding arms (lower-stage arm) 21R and 21L abuts on a sheet P2. The feeding arms 21R and 21L are rotatably attached with the feeding roller driving shaft 24 as a rotation center. The feeding arms 21R and 21L rotatably support both ends of a feeding roller shaft that is a rotating shaft of the lower-stage feeding roller 2. In addition, the feeding roller driving shaft 24 extends in the direction that intersects the supplying and conveying direction of the sheets P1 and P2, and the feeding roller shaft 23 that is a rotating shaft of the lower-stage feeding roller 2 is disposed substantially parallel to the feeding roller driving shaft 24. The second feeding motor 207 that is a second driving source gives a driving force to the feeding roller driving shaft 24, and this driving force is transmitted to the input gears 25R and 25L for driving the lower-stage cassette that are fixed to the feeding roller driving shaft 24 and are rotated integrally with the feeding driving shaft 24.

The driving of the input gears 25R and 25L for driving the lower-stage cassette is transmitted to driving idler gears 26R and 27R (right side) provided on the feeding arm 21R, and driving idler gears 26L and 27L (left side) provided on the feeding arm 21L. The driving force is further transmitted to feeding driving gears 28R and 28L that are fixed onto the feeding roller shaft 23 holding the lower-stage feeding roller 2, and that rotate integrally with the feeding roller shaft 23. That is, a configuration is provided in which the driving force is simultaneously transmitted to the lower-stage feeding roller 2 from both the right and left sides. Thereby, torque in a downwardly rotating direction is applied only on an arm on driving transmission side if driving is transmitted only from one feeding arm, and a downward force by the driving torque acts only on one end of the feeding roller shaft 23. Since the feeding roller shaft is long in the right-and-left direction (the sheet width direction), the right and left balance of the pressure contact force of the lower-stage feeding roller 2 to a sheet will become uneven. By arranging driving transmission gear trains on both the feeding arms 21R and 21L, stable feeding is able to be performed.

The feeding arms 21R and 21L of the lower-stage feeding roller 2 are located on the right and left outsides (outsides in the direction that intersects the supplying and conveying direction of a sheet) of the upper-stage cassette 3 in the sheet width direction. By virtue of this configuration, the sheets P1 with a paper width of the same maximum size as the lower-stage cassette 4 are able to be stacked in the upper-stage cassette 3. Additionally, when the sheets P1 stacked in the upper-stage cassette 3 are separated, fed, and conveyed, convey is performed in the direction of arrow D. However, at this time, a sheet P1 is conveyed so as to pass over the feeding roller shaft 23 having the lower-stage feeding roller 2. Additionally, this configuration enables the upper-stage and lower-stage cassettes 3 and 4 to be manipulated independently. That is, in the case of dismounting, the upper-stage and lower-stage cassettes are pulled out in the direction of arrow J, and in the case of mounting, the upper-stage and lower-stage cassettes are able to be pushed in the direction (the sheet feeding direction) of arrow I, and slidably mounted into the printer body from the front of the printer body. This manipulation is able to be performed independently for each of the upper-stage and lower-stage cassettes 3 and 4.

Moreover, the configuration of mounting and dismounting of the cassettes will be described with reference to FIGS. 1A and 1B and FIG. 4.

In a case where a user makes the upper-stage cassette 3 slide and pulls out the upper-stage cassette, as illustrated in FIG. 1B and 4, the upper-stage cassette 3 is pulled out in the direction of the arrow J, and one of replacement and setting of the sheets P1 are performed. At this time, the sheet discharge tray 16 is folded upward, so that the upper-stage cassette 3 is able to be easily taken out from the front portion of the printer body. In a case where the upper-stage cassette 3 is mounted on the printer body, as illustrated in FIG. 1A, the upper-stage cassette 3 is pushed in the direction of the arrow I, and is set at a predetermined mounting position. Similarly, pull-out and mounting of the lower-stage cassette 4 are also able to be performed independently.

By virtue of the configuration as described above, sheets of maximum size in the width direction and longitudinal direction of a sheet are able to be stacked in the upper-stage and lower-stage sheet stacking and supplying parts. It is possible to minimize (make compact) the body height and depth of these configurations and to realize the configurations at low cost. Additionally, since the upper-stage and lower-stage cassettes 3 and 4 are able to be manipulated independently, it is also possible to perform improvement in user's operability for the user.

Second Embodiment

Figure 5A:
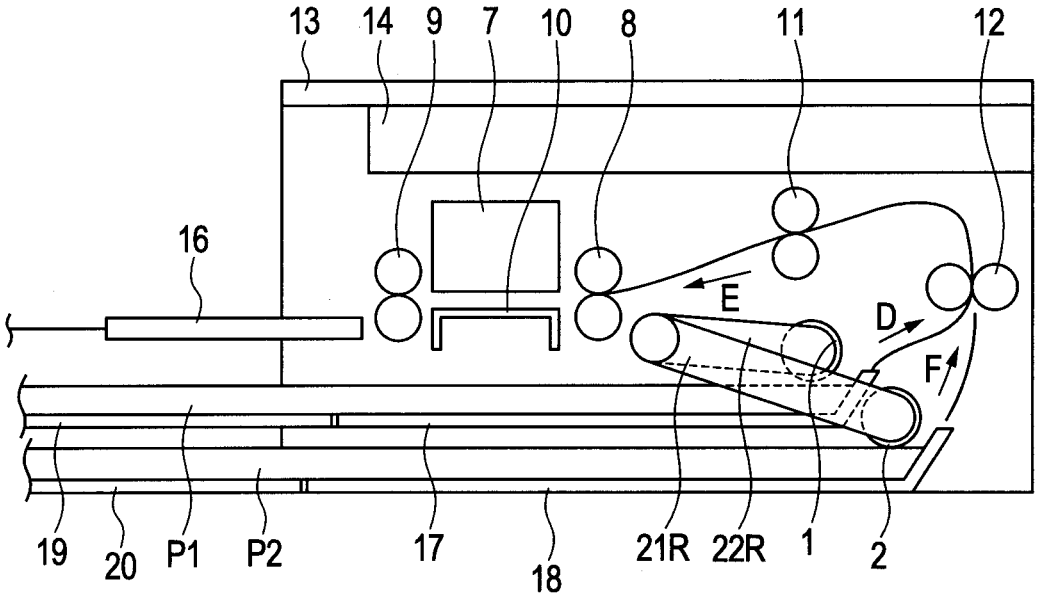
FIGS. 5A and 5B are cross-sectional views of a printer of a second embodiment.
Figure 5B:
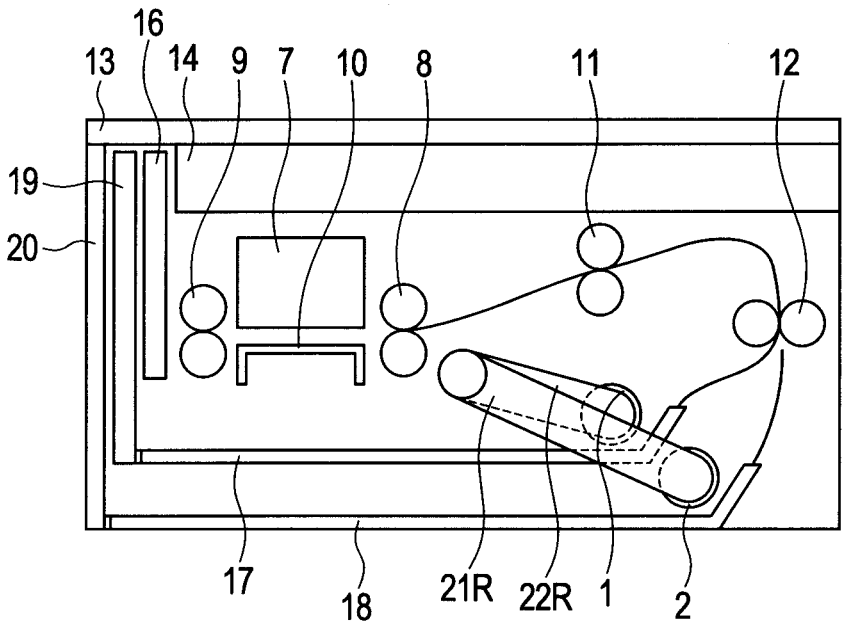

In the above-described first embodiment, the configuration in which the upper-stage and lower-stage cassettes 3 and 4 capable of being mounted on or dismounted from the printer body are used as a unit for stacking and supplying the sheets P1 and P2 has been described. However, according to the invention, the same effects as the first embodiment are able to be obtained even in the configuration using a fixed sheet stacking and supplying part. A second embodiment will be described with reference to FIGS. 5A and 5B. FIGS. 5A and 5B are cross-sectional views of a printer of the second embodiment.

A set state of the sheets P1 and P2 will be described with reference to FIG. 5A.

Even in the printer of the present embodiment, two sheet stacking and supplying parts corresponding to two types of sheets are disposed at upper and lower stages inside the printer body. However, in the present embodiment, the upper sheet stacking and supplying part includes an upper-stage sheet stacking part 17, and an upper-stage feeding tray 19 having an opening-and-closing mechanism, which make it possible to stack the sheets P1 on both of these. The lower sheet stacking and supplying part includes a lower-stage sheet stacking part 18, and a lower-stage feeding tray 20 having an opening-and-closing mechanism, which enable the sheets P2 to be stacked on both of these.

Next, the state of the feeding tray in no use will be described with reference to FIG. 5B.

Similarly to the first embodiment, the sheet discharge tray 16 having an opening-and-closing mechanism is folded upward, and is housed in the front portion of the printer body. The upper-stage feeding tray 19 and the lower-stage feeding tray 20 are also folded upward similarly, and are housed in the front portion of the printer body.

Since the other configuration (configuration of feeding and driving of the upper-stage feeding roller 1, the lower-stage feeding roller 2, or the like) is the same as that of the first embodiment, and reference numerals in the drawing are also the same, the description thereof is omitted.

Third Embodiment

In the first embodiment, the configuration in which the driving force of the lower-stage feeding roller is transmitted from both the right and left sides in the sheet width direction has been described. However, in a case where the rigidity of the feeding arms 21R and 21L and the feeding roller shaft 23 is able to be made high, the configuration in which driving is made from one side is also possible.

Fourth Embodiment

In the first embodiment, the configuration in which positioning of the sheets P1 and P2 of the upper-stage and lower-stage cassettes 3 and 4 in the width direction is performed on a center reference has been described. Even in a one-side-based positioning configuration based on any one of right and left sheet end portions of maximum width size, the same effects as those the above-described first embodiment are obtained.

According to the respective embodiments as described above, the upper-stage feeding roller is arranged in the upper part of the upper-stage sheet stacking and supplying part, and the support arm and a driving transmission unit of the lower-stage feeding roller are arranged outside the upper-stage sheet stacking and supplying part. A sheet is able to be supplied to each sheet stacking and supplying part from the front side of the apparatus body. A rotation arm portion that holds the lower-stage feeding roller and makes the roller abut on a sheet on the lower-stage side is provided outside the upper-stage sheet stacking and supplying part. By virtue of such a configuration, a sheet stacking and loading part of a size capable of coping with sheets of maximum size is able to be provided at any of the upper and lower stages. Additionally, since the configuration is provided in which the upper-stage sheet stacking and supplying part and the lower-stage feeding roller are made to overlap each other in the body height direction similarly to the related art while minimizing the depth of the printer body, miniaturization of a printer is able to be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-145771, filed Jun. 30, 2011, which is hereby incorporated by reference herein in its entirety.

What is claimed is:

1. A sheet feeder comprising:

a first sheet stacking part and a second sheet stacking part located below the first sheet stacking part;

a first roller that feeds sheets stacked in the first sheet stacking part;

a first arm that supports the first roller and is supported rotatably;

a second roller that feeds sheets stacked in the second sheet stacking part; and a second arm that supports the second roller and is supported rotatably, wherein at least a portion of the first sheet stacking part and at least a portion of the second arm are arranged so as to be lined up in the width direction of the sheets stacked in the first sheet stacking part, and wherein the second arm is located outside of the first sheet stacking part in the width direction of the sheets stacked in the first sheet stacking part.

2. The sheet feeder according to claim 1, wherein each of the first and second sheet stacking parts has a cassette that accommodates a plurality of sheets overlappingly.

3. The sheet feeder according to claim 2, wherein the cassette is capable of being mounted on and dismounted from the recording apparatus.

4. The sheet feeder according to claim 2, wherein the cassette as the first sheet stacking part is adapted so as to be slidable through below the first roller in a feeding direction of the sheets.

5. The sheet feeder according to claim 1, further comprising a third arm that is supported rotatably, and wherein both ends of a shaft that supports the second roller are supported by the second arm and the third arm, at least a portion of the first sheet stacking part is arranged between the second arm and the third arm, and a driving force that drives the second roller is transmitted to both ends of the shaft that supports the second roller.

6. The sheet feeder according to claim 1, wherein the axes are centers of rotation of the first arm and the second arm are the same.

7. The sheet feeder according to claim 1, wherein the first and second sheet stacking parts have a positioning unit that performs positioning of an end portion of a sheet in a direction that intersects a supplying and conveying direction of the sheet, and the position of the positioning unit is variable on the reference of the center of the sheet.

8. A recording apparatus comprising:

the sheet feeder according to claim 1; and a recording unit that performs recording on a sheet fed from the sheet feeder.

9. A processing device comprising:

the sheet feeder according to claim 1; and a processing unit that performs processing on a sheet fed from the sheet feeder.

10. A sheet feeder comprising:

a first sheet stacking part;

a second sheet stacking part located below the first sheet stacking part;

a first roller configured to feed sheets stacked in the first sheet stacking part;

a first arm configured to support the first roller;

a second roller configured to feed sheets stacked in the second sheet stacking part; and a pair of second arms configured to support the second roller, wherein the first sheet stacking part is located between the pair of second arms, and wherein the pair of second arms is located outside of the first sheet stacking part in the width direction of the sheets stacked in the first sheet stacking part.

11. The sheet feeder according to claim 1, wherein each of the first and second sheet stacking parts has a cassette that accommodates the sheets.

12. The sheet feeder according to claim 11, wherein the cassette corresponding to the first sheet stacking part is configured so as to be slidable below the first roller in a feeding direction of the sheets.

13. The sheet feeder according to claim 10, wherein a shaft of the second roller is supported by the pair of second arms, and a driving force is transmitted to the shaft.

14. The sheet feeder according to claim 13, wherein one of the pair of second arms supports a transmission unit configured to transmit the driving force to the shaft.

15. The sheet feeder according to claim 10, wherein the first arm and the pair of second arms are rotatably supported with a common shaft.

16. The sheet feeder according to claim 10, wherein the first and second sheet stacking parts have a positioning unit that performs positioning of an end portion of a sheet in a direction that intersects a feeding direction of the sheet, and the position of the positioning unit is variable with respect to a center of the sheet.

17. A recording apparatus comprising:

a first sheet cassette;

a second sheet cassette located below the first sheet cassette;

a first roller configured to feed sheets stacked on the first sheet cassette;

a second roller configured to feed sheets stacked on the second sheet cassette;

a pair of arms configured to support the second roller; and a recording unit configured to record an image on a sheet fed from either one of the first sheet cassette and the second sheet cassette, wherein the first sheet cassette is located between the pair of arms, and wherein the pair of second arms is located outside of the first sheet cassette in the width direction of the sheets stacked in the first sheet cassette.

18. The recording apparatus according to claim 17, wherein the first roller is supported by an arm, and the arm of the first roller and the pair of arms of the second roller are rotatably supported with a common shaft.

19. A sheet feeder comprising:

a first sheet stacking part;

a second sheet stacking part located below the first sheet stacking part;

a first roller configured to feed sheets stacked on the first sheet stacking part;

a second roller configured to feed sheets stacked on the second sheet stacking part;

a pair of arms configured to support the second roller; and wherein the first sheet stacking part is located between the pair of arms, and wherein the pair of arms is located outside of the first sheet stacking part in the width direction of the sheets stacked in the first sheet stacking part.

20. The sheet feeder according to claim 19, wherein the first roller is supported by an arm, and the arm of the first roller and the pair of arms of the second roller are rotatably supported with a common shaft.

* * * * *